US008324834B2

(12) United States Patent
Wang et al.

(10) Patent No.: US 8,324,834 B2
(45) Date of Patent: Dec. 4, 2012

(54) LOAD DRIVING CIRCUIT AND MULTI-LOAD FEEDBACK CIRCUIT

(75) Inventors: Chen-Hsung Wang, Taipei County (TW); Chung-Che Yu, Taipei County (TW); Li-Min Lee, Taipei County (TW); Shian-Sung Shiu, Taipei County (TW)

(73) Assignee: Green Solution Technology Co., Ltd., Taipei County (TW)

( * ) Notice: Subject to any disclaimer, the term of this patent is extended or adjusted under 35 U.S.C. 154(b) by 81 days.

(21) Appl. No.: 12/902,290

(22) Filed: Oct. 12, 2010

(65) Prior Publication Data

US 2011/0089865 A1 Apr. 21, 2011

(30) Foreign Application Priority Data

Oct. 16, 2009 (TW) ..... 98135006 A
Jul. 2, 2010 (TW) ..... 99121757 A

(51) Int. Cl.
*H05B 37/02* (2006.01)
*H05B 37/00* (2006.01)

(52) U.S. Cl. ..... 315/291; 315/312

(58) Field of Classification Search ..... 315/224, 315/246, 209 R, 291, 307, 312, 185 R, 299, 315/300

See application file for complete search history.

(56) References Cited

U.S. PATENT DOCUMENTS

| | | | | |
|---|---|---|---|---|
| 7,518,525 | B2 * | 4/2009 | Chou | 340/815.45 |
| 7,541,750 | B2 * | 6/2009 | Shen et al. | 315/291 |
| 7,847,783 | B2 * | 12/2010 | Liu et al. | 345/102 |
| 7,868,972 | B2 * | 1/2011 | Choi et al. | 349/68 |
| 2009/0128045 | A1 * | 5/2009 | Szczeszynski et al. | 315/185 R |
| 2009/0187925 | A1 * | 7/2009 | Hu et al. | 719/327 |

* cited by examiner

*Primary Examiner* — Minh D A
(74) *Attorney, Agent, or Firm* — Rosenberg, Klein & Lee

(57) ABSTRACT

A load driving circuit and a multi-load feedback circuit is disclosed. The load driving circuit and the multi-load feedback circuit are adapted to drive a LED module that has a current balancing circuit for balancing the currents flowing through LEDs. The load driving circuit and the multi-load feedback circuit modules the electric power transmitted by the LED driving apparatus to a LED module according to voltage level(s) of current balancing terminals having insufficient voltage in the current balancing circuit, and so the voltage levels of the current balancing terminals are higher than or equal to a preset voltage level, further increasing the efficiency thereof.

15 Claims, 6 Drawing Sheets

LOAD DRIVING CIRCUIT AND MULTI-LOAD FEEDBACK CIRCUIT

BACKGROUND OF THE INVENTION (1) Field of the Invention

The present invention relates to a load driving circuit and a multi-load feedback circuit; in particular, it relates to a load driving circuit and a multi-load feedback circuit used to drive plural Light Emitting Diode strings.

(2) Description of the Prior Art

Refer first to FIG. 1, wherein a schematic diagram of a conventional constant current driving apparatus for LEDs is shown. The illustrated LED constant current driving apparatus comprises a current balancing circuit 10, a LED module 60 and an electrical power supply 70. The electrical power supply 70 stabilizes the output voltage VOUT through a voltage feedback signal VFB generated by a voltage feedback circuit. The LED module 60 has plural LED strings connected in parallel between the electrical power supply 70 and the current balancing circuit 10. The current balancing circuit 10 has a current setting resistor 11 as well as a current mirror composed of a transistor 12 and multiple transistors 20. One terminal of the current setting resistor 11 is coupled to a voltage VCC, and the other terminal thereof coupled to the transistor 12, thereby allowing a setting current to flow through the transistor 12. The transistor 20 is one-to-one, individually connected to a corresponding LED strings in the LED module 60, and mirrors the setting current, thereby allowing the setting current to flow through the LEDs for light emissions. In this way, substantially equal current can flow through each LED in the LED module 60 for substantially emitting same brightness.

Due to significant differences in threshold voltages between the LEDs, the required driving voltage value to maintain the same current may vary. For example, with a current of 20 mA flowing therethrough, the required driving voltage for one single LED is roughly within a range of 3.4~3.8V, and each LED string in the LED module 60 has 20 LEDs, the required driving voltage for one LED string is accordingly within a range of roughly 68~76V, and the difference in the difference of driving voltage between each series of LEDs is endured by the transistor switch 20. Besides, the transistor switch 20 must operate in the saturation range to mirror current. Therefore, to ensure each LED string to acquire the same current flowing therethrough, the output voltage VOUT provided by the electrical power supply 70 must be higher than the maximum driving voltage, e.g., 80V, thereby ensuring the transistor switch 20 to operate in the saturation range.

Nevertheless, the driving voltages required by the LED strings is unlikely to be individually confirmed beforehand, so the maximum driving voltage for the LED strings in the LED module 60 may be lower than 76V. As a result, excessive provision of 80V as the driving voltage may contrarily cause reduced illumination efficiency. Furthermore, to prevent LED string from open-circuit due to any LED damage in the LED string, the LED can be connected in parallel to a Zener diode, such that current can be successfully bypass through the Zener diode when the LED is damaged. The breakdown voltage in the Zener diode is set to be higher than the threshold voltage of LED, e.g., 2V., so as to prevent occurrences of erroneous actions in the Zener diode. Under such circumstances, if two LEDs are damaged in the same LED string, thus resulting in approximately 4V increments in the driving voltage of the LED strings, it is possible to lead to significant reduction in the current flowing through the LED strings or even no current. Alternatively, to increase the output voltage VOUT provided by the electrical power supply 70 to keep the amount of current, illumination efficiency may be undesirably lowered.

SUMMARY OF THE INVENTION

In view of that, to ensure stable light emissions for the LED module, the conventional constant voltage driving apparatus for LEDs provides a driving voltage higher than the required voltage, yet the overly high driving voltage may cause lowered efficiency of the LED driving apparatus. The present invention is directed to resolve the efficiency issue of the LED driving apparatus by, in accordance with the voltage level associated with one or more current balancing terminals having insufficient voltage level in the current balancing circuit of the LED driving apparatus, adjusting the electric power required to drive the LED module in the LED driving apparatus, such that the LED driving apparatus is capable of balancing the current flowing through each LED as well as improving efficiency.

To achieve the aforementioned objective, the present invention provides a multi-load feedback circuit which is adapted to control a load driving circuit to adjust the electric power to drive a plurality of loads connected in parallel. The multi-load feedback circuit according to the present invention comprises a plurality of semiconductor switches. Each semiconductor switch includes a first terminal, a second terminal and a third terminal, wherein the first terminals are coupled to corresponding plurality of the reference voltages, the second terminals are respectively coupled to corresponding loads, and the third terminals are coupled with each other to generate a detection signal according to each conducting state of the plurality of semiconductor switches in the conducting states, for having the load driving circuit to accordingly adjust the electric power to drive the plurality of loads.

The present invention also provides a load driving circuit for driving plural LED strings connected in parallel. The load driving circuit according to the present invention comprises an electrical power supply, a current balancing circuit and a multi-load feedback circuit. The electrical power supply is coupled to the plural LED strings for driving the plural LED strings. The current balancing circuit includes a plurality of current balancing terminals correspondingly coupled to the plural LED strings for balancing the current flowing through the plural LED strings. The multi-load feedback circuit includes a plurality of semiconductor switches. Each semiconductor switch is respectively coupled to a corresponding current balancing terminal among the plurality of current balancing terminals and is conducted or cut off based on based on the voltage level of the corresponding plurality of current balancing terminals and a reference voltage of the corresponding plurality of the reference voltages. Herein the multi-load feedback circuit generates a detection signal based on the voltage level(s) associated with the current balancing terminal(s) corresponding to semiconductor switch(es) conducted, for having the electrical power supply to adjust the power to drive the plural LED strings according to the detection signal Therefore, the driving electrical power provided by the load driving circuit according to the present invention can be set to a lower level and adjusted depending on the electrical power actually required by the LED module, so as to improve the efficiency thereof.

The aforementioned summary as well as the detailed descriptions set forth hereinafter both aim to further illustrate the scope of the present invention. Other purposes and advantages in relation to the present invention will be construed with reference to the following specifications and appended drawings thereof.

BRIEF DESCRIPTION OF THE DRAWINGS

The present invention will now be specified with reference to its preferred embodiment illustrated in the drawings, in which.

DESCRIPTION OF THE PREFERRED EMBODIMENT

Figure 1:
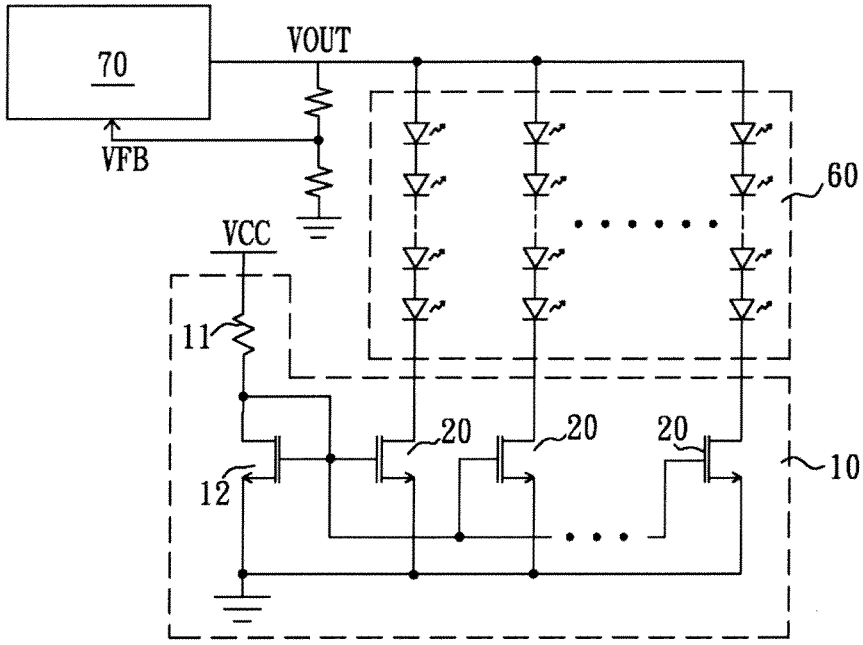
Figure 1 (PRIOR ART)
FIG. 1 is a schematic diagram of a conventional constant current driving apparatus for LEDs.
Figure 2:
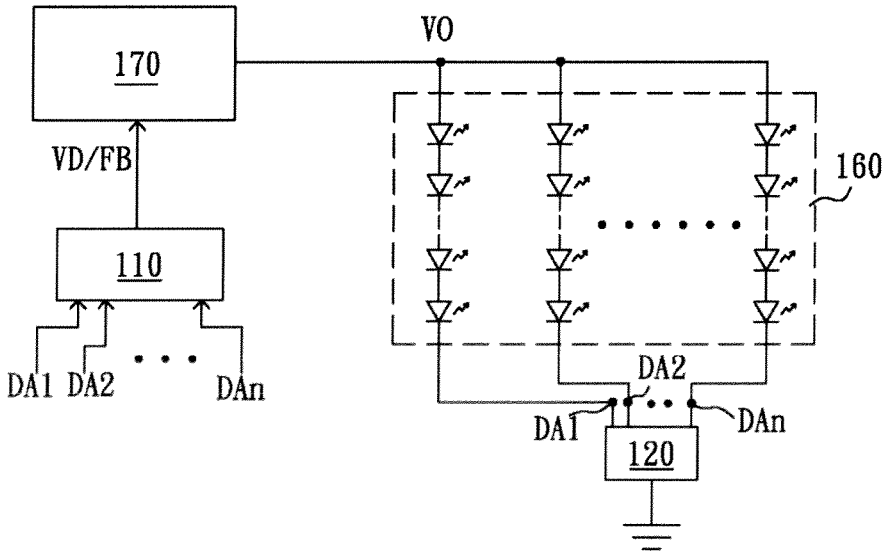
FIG. 2 is a schematic diagram of the load driving circuit according to the present invention.

Referring now to FIG. 2, wherein a schematic diagram of the load driving circuit according to the present invention is shown. The depicted load driving circuit comprises a multi-load feedback circuit 110, a current balancing circuit 120 and an electrical power supply 170 for driving a Light Emitting Diode (LED) module 160. The LED module 160 has plural LED strings connected in parallel, and each LED string has a plurality of LEDs connected in series. The electrical power supply 170 is coupled to the plural LED strings in the LED module 160, thereby providing an output voltage VOUT to drive the plural LED strings for lighting. The current balancing circuit 120 has a plurality of current balancing terminals DA1~DAn correspondingly coupled to the plural LED strings for balancing the current flowing through such plural LED strings, such that the current flowing there through becomes approximately equal. The multi-load feedback circuit 110 is coupled to the current balancing terminals DA1~DAn for generating a feedback signal FB or a detection signal VD based on the voltage levels of the current balancing terminals, thereby allowing the electrical power supply 170 to adjust the electrical power to drive the LED module 160 based on the detection signal VD or the feedback signal FB. In this way, the voltage levels of current balancing terminals DA1~DAn can be ensured to be above a predetermined level, yet confined not to become excessively high, thus keeping the efficiency of the load driving circuit at a higher level.

Figure 3:
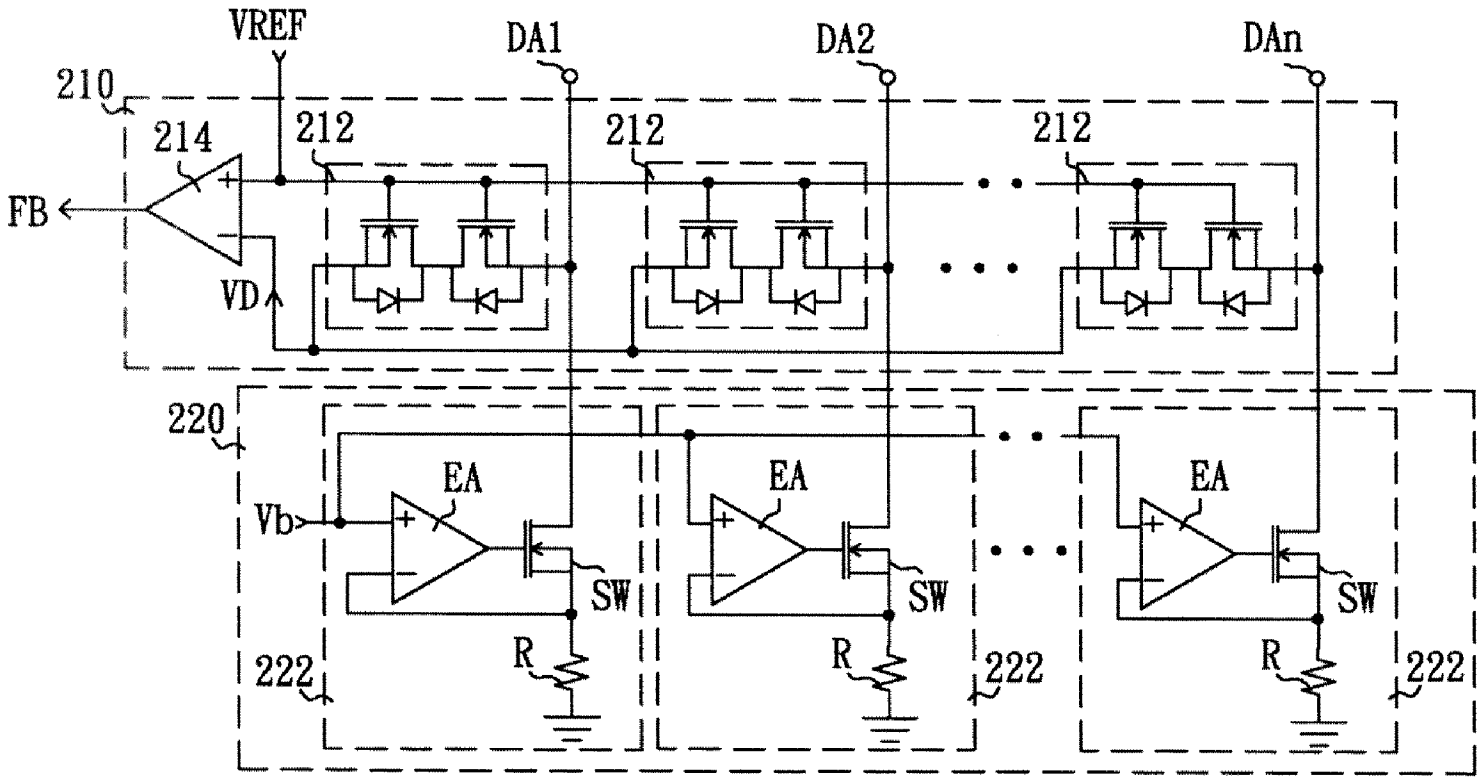
FIG. 3 is a schematic diagram of the multi-load feedback circuit according to a first embodiment of the present invention.

Next, refer to FIG. 3, wherein a schematic diagram of the multi-load feedback circuit according to a first embodiment of the present invention is shown. The present multi-load feedback circuit 210 comprises a plurality of semiconductor switches 212 and a determining circuit 214. Each semiconductor switch has a first terminal, a second terminal and a third terminal. The first terminals are coupled to a common reference voltage VREF. The second terminals are individually coupled to the plurality of current balancing terminals DA1~DAn of the current balancing circuit 220; that is, coupled to the plural LED strings in the LED module 160. The third terminals are coupled with each other and also coupled to the determining circuit 214, thereby generating a detection signal VD to the determining circuit 214.

The current balancing circuit 220 includes a plurality of current balancing units 222, with each current balancing unit 222 including a transistor switch SW, a resistor R and an error amplifier EA. Each of resistors R generates a current detection signal to the inverse terminal of a corresponding error amplifier EA based on the current flowing through a corresponding current balancing terminal among the current balancing terminals DA1~DAn. The non-inverse terminals of the error amplifiers EA receive the same current reference signal Vb, and accordingly the error amplifiers EA control the equivalent resistance of the transistor switch SW, such that the voltage level of the current detection signal is equal to the level of the current reference signal Vb. Therefore, the current balancing unit 222 is able to control the current flowing through the LED strings coupled to the current balancing terminals DA1~DAn.

In the present embodiment, each semiconductor switch 212 in the multi-load feedback circuit 210 has two Metal-Oxide-Semiconductor Field Effect Transistors (MOSFET's), in which the drains of the two MOSFET's are coupled with each other and both the gates thereof are connected to the common reference voltage VREF. One of the sources of the two MOSFET's is coupled to a corresponding current balancing terminal among the plurality of current balancing terminals DA1~DAn, while the other one source is coupled to the determining circuit 214. Additionally, the body diodes of the two MOSFET's are arranged in an opposite direction, so as to prevent transfers of the current signal or voltage signal via the body diodes of the two MOSFET's when the two MOSFET's are both in a cutoff state. The determining circuit 214 includes a comparator, in which the inverse terminal of the comparator receives the detection signal VD and the non-inverse terminal of the comparator receives the common reference voltage VREF; the comparator generates the feedback signal FB from the output terminal.

When any one of the plurality of current balancing terminals DA1~DAn has a voltage level lower a predetermined voltage difference than the common reference voltage VREF (i.e., there is a voltage difference higher than the conducting voltage of the semiconductor switch 212), the semiconductor switch 212 is in a conducting state, otherwise in a cutoff state. That is, the semiconductor switch 212 is conducted or cutoff based on the voltage level of the corresponding current balancing terminal, and it also determines the level of the detection signal VD based on the voltage level(s) of the current balancing terminal(s) corresponding to the conducted semiconductor switch(es) 212. In the present embodiment, since the semiconductor switch 212 includes two MOSFET's, the level of the detection signal VD is determined based on an average value of the voltage levels of the current balancing terminals corresponding to the conductive semiconductor switches 212, and lower than the common reference voltage VREF by at least a predetermined voltage difference. Meanwhile, the determining circuit 214 outputs a feedback signal FB of high level. The electrical power supply 170 shown in FIG. 2 increases the electrical power to drive the LED module 160 upon reception of the feedback signal FB of high level. That is, the output voltage VO is elevated so as to increase the voltage level at the current balancing terminals DA1~DAn, until the feedback signal FB turns to low level, thus having the voltage levels at the current balancing terminals DA1~DAn all to be higher than or equal to the common reference voltage VREF.

Consequently, the load driving circuit according to the present invention adjusts the electrical power to drive the LED module 160 based on the signal from the multi-load circuit, such that the voltage level at each current balancing terminal is higher than or equal to a predetermined voltage. When the voltage level at the current balancing terminal having the lowest level is higher than or equal to a predetermined level, the load driving circuit no longer increases the electrical power to drive the LED module 160 in order to confine the voltage difference between the current balancing terminal and ground into a limited range, thus keeping higher efficiency of the circuitry.

Figure 4:
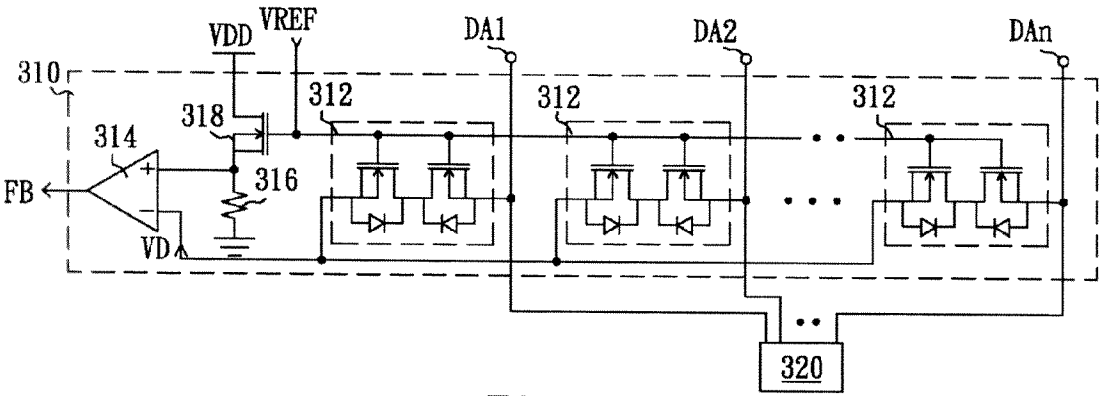
FIG. 4 is a schematic diagram of the multi-load feedback circuit according to a second embodiment of the present invention.

Refer next to FIG. 4, wherein a schematic diagram of the multi-load feedback circuit according to a second embodiment of the present invention is shown. The multi-load feedback circuit 310 comprises a plurality of semiconductor switches 312, an error amplifier 314, a resistor 316 and a transistor switch 318. Each semiconductor switch 312 has a first terminal, a second terminal and a third terminal. The first terminals are coupled to a common reference voltage VREF. The second terminals are individually coupled to the plurality of current balancing terminals DA1~DAn of the current balancing circuit 320. The third terminals are coupled with each other and also coupled to the error amplifier 314 thereby generating a detection signal VD to the error amplifier 314. In the present embodiment, the circuits and operations of the semiconductor switch 312 is identical to which of the semiconductor switch 212 illustrated in FIG. 3, descriptions thereof are thus omitted for brevity.

The most significant difference between the multi-load feedback circuit 310 of the present embodiment and the multi-load feedback circuit 210 shown in FIG. 3 lies in that the determining circuit 214 is replaced by the error amplifier 314, the resistor 316 and the transistor switch 318. The drain of the transistor switch 318 is coupled to a drive voltage VDD, the source of the transistor switch 318 is coupled to the resistor 316 and the non-inverse terminal of the error amplifier 314, and the gate thereof is coupled to the common reference voltage VREF. Therefore, the transistor switch 318 is maintained in a conducting state and a conducting voltage difference exists between the gate and the source. In other words, the signal received at the non-inverse terminal of the error amplifier 314 has a voltage level that is the common reference voltage VREF minus the conducting voltage difference. The semiconductor switch 312 also has a voltage drop therein when the semiconductor switch 312 is conducted because the level at the corresponding current balancing terminal is lower than the common reference voltage VOUT by a predetermined voltage difference. Consequently, through the placements of the resistor 316 and the transistor switch 318, it is possible to compensate the voltage drop occurring in the conducted semiconductor switch 312. Additionally, the error amplifier 314 outputs the feedback signal FB based on the voltage difference between the inverse terminal and the non-inverse terminal so as to have the electrical power supply 170 to adjust the power to drive the LED module 160, thereby making the voltage levels at the current balancing terminals DA1~DAn become higher than or equal to (common reference voltage VOUT-conducting voltage difference).

Figure 5:
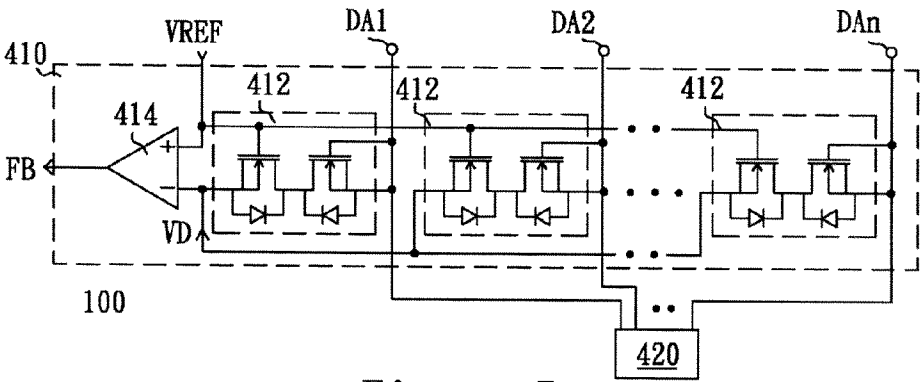
FIG. 5 is a schematic diagram of the multi-load feedback circuit according to a third embodiment of the present invention.

Subsequently, refer to FIG. 5, wherein a schematic diagram of the multi-load feedback circuit according to a third embodiment of the present invention is shown. Compared with the multi-load feedback circuit 212 depicted in FIG. 3, each gate of the MOSFETs', having the sources thereof coupled to the current balancing terminals DA1~DAn, is coupled to the corresponding current balancing terminal, rather than the common reference voltage VREF, so the MOSFET is maintained in a cutoff state. When the level at the current balancing terminal is lower than the common reference voltage VREF by a predetermined voltage difference thereby causing the corresponding multi-load feedback circuit 412 to be in a conducting state, the signal of the current balancing terminal will be passed to the inverse terminal of the comparator 414 through the body diode of the MOSFET in cutoff and another MOSFET conducted. As a result, the multi-load feedback circuit 412 according to the present embodiment can, as the multi-load feedback circuits illustrated in the previous embodiments, control the load driving circuit to adjust the electrical power to drive the LED module 160 through the feedback signal FB generated by the comparator 414. Since one of the two MOSFET's in the multi-load feedback circuit 412 is in a cutoff state all the time that only the feature of diode is demonstrated by the body diode, the current balancing terminal having the lowest voltage level among the current balancing terminals DA1~DAn dominates the level of the detection signal VD, such that the level of the current balancing terminal having the lowest voltage is higher than or equal to a predetermined voltage level, thus ensuring the levels of all current balancing terminals DA1~DAn to be higher than or equal to the predetermined voltage level.

Figure 6:
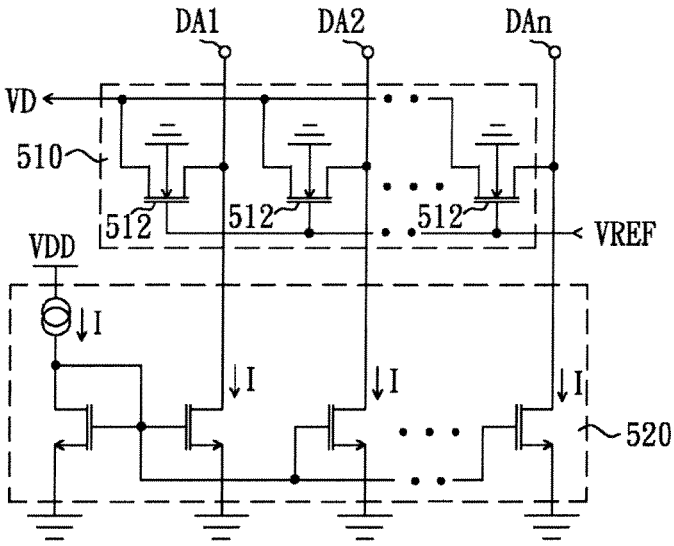
FIG. 6 is a schematic diagram of the multi-load feedback circuit according to a fourth embodiment of the present invention.

Next, refer to FIG. 6, wherein a schematic diagram of the multi-load feedback circuit according to a fourth embodiment of the present invention is shown. The multi-load feedback circuit 510 comprises a plurality of semiconductor switches 512. Each semiconductor switch 512 has an N-type transistor switch whose gate is coupled to the common reference voltage VREF. One of the source and the drain thereof is coupled to a corresponding current balancing terminal among the current balancing terminals DA1~DAn of the current balancing circuit 520, and the other one being coupled with each other in order to generate a detection signal VD, while the base thereof coupled to ground. Due to the base being grounded, it ensures that the reverse biased body diode of the N-type transistor switch is cut off. Hence, the plurality of semiconductor switches 512 transfer the voltage levels of the current balancing terminals DA1~DAn to the detection signal VD only when the voltage levels at the corresponding current balancing terminals DA1~DAn lower than the common reference voltage VREF by a predetermined voltage difference. The level of detection signal VD is determined based on an average value of the levels at the current balancing terminals corresponding the conducted semiconductor switches 512, as the embodiment shown in FIG. 3. At this moment, the electrical power supply 170 increases the electrical power to drive the LED module 160 in accordance with the detection signal VD thereby gradually elevating the levels at the current balancing terminals DA1~DAn, until all of the semiconductor switches 512 are in a cutoff state.

Furthermore, the multi-load feedback circuit according to the present invention may operate conjunctively with the current balancing circuit formed by the plurality of current balancing units 222 shown in FIG. 3, and may also alternatively cooperate with the current balancing circuit 520 formed by a current mirror circuit or other circuits capable of balancing current. In FIG. 6, the current mirror circuit has multiple transistor switches with gates and sources thereof being mutually connected, wherein the current I generated by a current source is mirrored and thus flows through each transistor switch, such that the current balancing terminals DA1~DAn formed by the drains of the transistor switches have the equal current flowing therethrough.

The multi-load feedback circuit can not only use MOSFET to generate a detection signal or a feedback signal as mentioned in the above embodiment, but also use the bipolar junction transistor to be the detecting component for detecting the voltages of the current balancing terminals. Wherein, one of the emitter and the base of the bipolar junction transistor is coupled to a common reference voltage, and the other of it is coupled to a corresponding current balancing terminal. Accordingly, when the different voltage between each current balancing terminal and the common reference voltage reaches the forward bias voltage, such that the bipolar junction transistor is in the conducting state, the voltage level at each current balancing terminal can be transmitted through the conducting bipolar junction transistor, so as to reach the function as the above embodiment.

Figure 7:
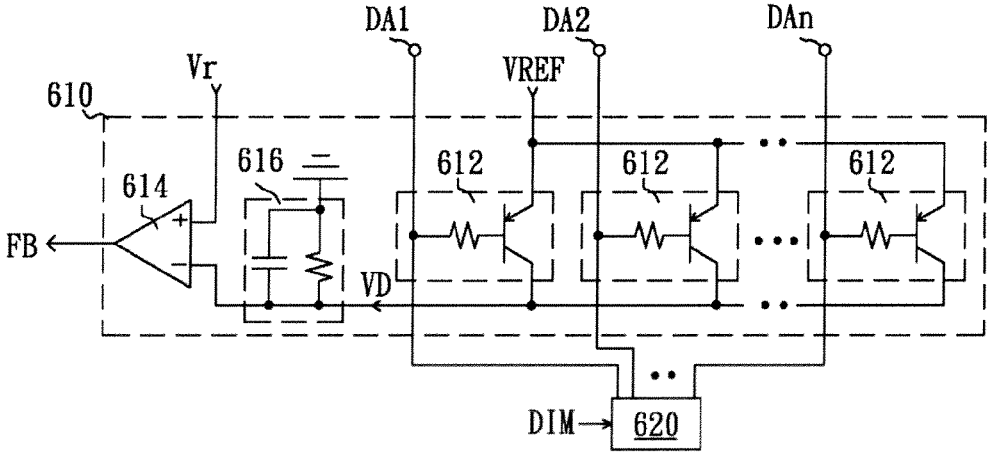
FIG. 7 is a schematic diagram of the multi-load feedback circuit according to a fifth embodiment of the present invention.

Refer now to FIG. 7, wherein a schematic diagram of the multi-load feedback circuit according to a fifth embodiment of the present invention is shown. Compared with the embodiment depicted in FIG. 6, the multi-load feedback circuit 610 comprises a plurality of semiconductor switches 612. Each semiconductor switch 612 is formed by a PNP bipolar junction transistor and a resistor. The emitters of the bipolar junction transistors are coupled to the common reference voltage VREF, the bases of the bipolar junction transistors are coupled to the corresponding current balancing terminals DA1~DAn in the current balancing circuit 620 through the resistor, and the collectors of the bipolar junction transistors are connected with each other. When the level at the current balancing terminal having the lowest level among the current balancing terminals DA1~DAn is lower than the common reference voltage VREF by a predetermined voltage difference, the corresponding bipolar junction transistor becomes conductive and the level at current balancing terminal having the lowest voltage level dominates the level in the detection signal VD.

In the present embodiment, the current balancing circuit may receive a dimming signal DIM and accordingly determines whether the currents flowing through the current balancing terminals DA1~DAn or not. At this point, due to such a signal, variations in the levels at the current balancing terminals DA1~DAn may occur, so the detection signal VD can be filtered through a filter circuit 616 in order to filter the noises, due to dimming, out of the detection signal VD and transmitted to a determining circuit 614. Thereby, the determining circuit 614 outputs a feedback signal FB according to a determining reference voltage Vr and the detection signal VD and the load driving circuit adjusts the provided electrical power in accordance with the feedback signal FB. Wherein, the voltage level of the determining reference voltage Vr and the common reference voltage VREF may be the same or not.

Figure 7A:
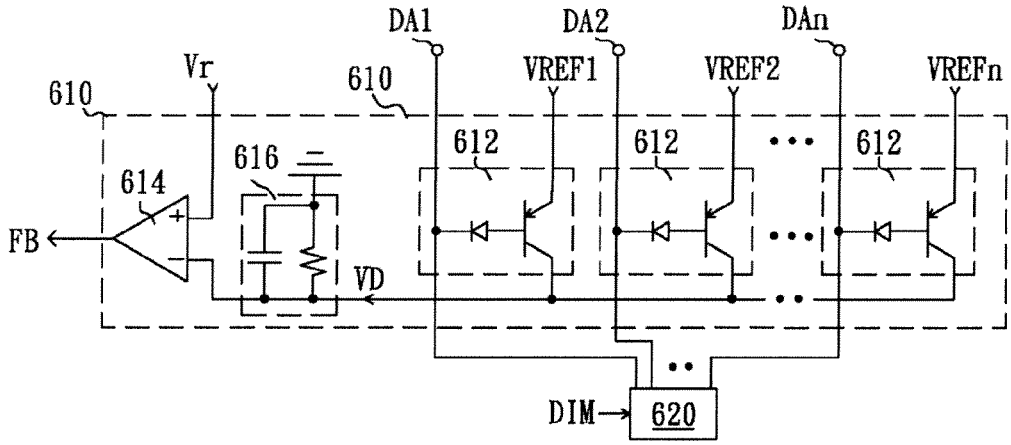
FIG. 7A is a schematic diagram of the multi-load feedback circuit according to a sixth embodiment of the present invention.

In addition, the common reference voltage VREF which is received by each semiconductor switch 612 may be replaced by different reference voltages VREF1~VREFn. Refer to FIG. 7A, wherein a schematic diagram of the multi-load feedback circuit according to a sixth embodiment of the present invention is shown. In the present embodiment, the multi-load feedback circuit 610 comprises a plurality of semiconductor switches 612.

Each semiconductor switches 612 comprises a PNP bipolar junction transistor and a diode. The emitters of the bipolar junction transistors are coupled to the different reference voltages VREF1~VREFn correspondingly, the collectors of the bipolar junction transistors are connected with each other. When the voltages of the current balancing terminals DA1~DAn are abnormally raised, e.g.: the current balancing circuit 620 is stopped the current by the dimming signal DIM or the multi-load feedback circuit is in the abnormal state, a reverse bias voltage may be generated between the base and the collector of each bipolar junction transistor or between the base and the emitter thereof. When the reverse bias voltage is too high and over the withstand voltage of the bipolar junction transistor, the bipolar junction transistor may be breakdown. Therefore, in the present embodiment, the diodes are coupled between the bases of each bipolar junction transistors and the current balancing terminals DA1~DAn correspondingly to avoid the plurality of semiconductor switches 612 being damaged because of the weaker withstand voltage. Compared with FIG. 7, the common reference voltage VREF is replaced by a plurality of the reference voltages VREF1~VREFn. The plurality of the reference voltages VREF1~VREFn are coupled to the corresponding emitters of the bipolar junction transistor in the plurality of the semiconductor switches 612. Beside from that, the plurality of the reference voltages VREF1~VREFn may be set based on the corresponding LED strings (i.e., to which the corresponding current balancing terminals DA1~DAn are coupled.) Such that the plurality of the reference voltages VREF1~VREFn may be all equal, partly equal, or all different. When the level at the current balancing terminal having the lowest level among the corresponding current balancing terminals DA1~DAn of the bipolar junction transistors is lower than the corresponding reference voltage by a predetermined voltage difference, the corresponding bipolar junction transistor becomes conductive and the level of the detection signal VD is adjusted according to the voltage level of the corresponding current balancing terminal. Furthermore, the determining reference voltage Vr is higher than any of the plurality of the reference voltages VREF1~VREFn. In other words, the determined level of the feedback signal FB and the determined level of each current balancing terminal, the level to conduct the corresponding semiconductor switch, are set by the system, so as to reduce the restriction of the circuit and increase the flexibility in use.

Figure 8:
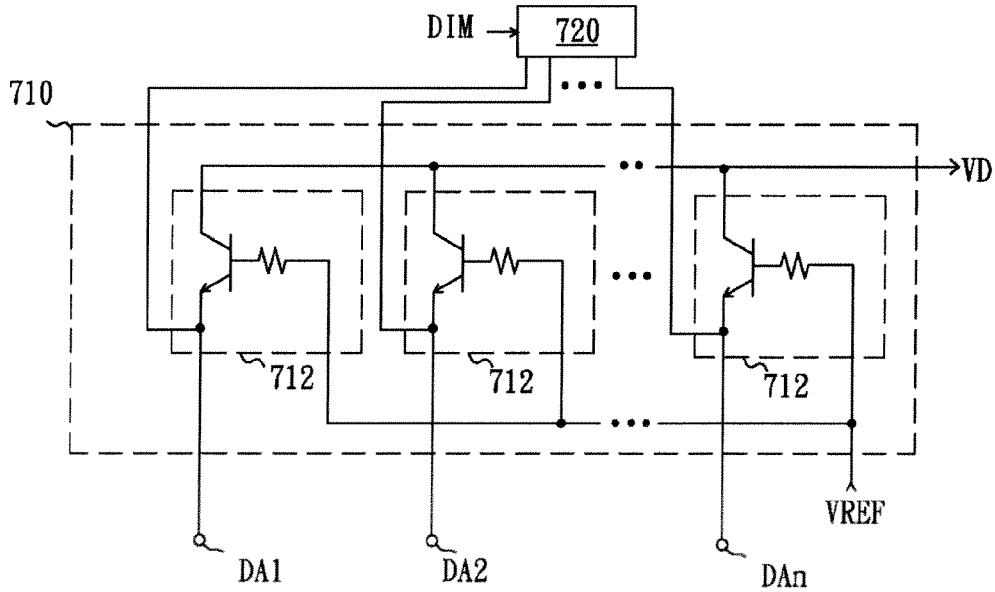
FIG. 8 is a schematic diagram of the multi-load feedback circuit according to a seventh embodiment of the present invention.

Next, refer to FIG. 8, wherein a schematic diagram of the multi-load feedback circuit according to a seventh embodiment of the present invention is shown. In the present embodiment, the multi-load feedback circuit 710 comprises a plurality of semiconductor switches 712. Each semiconductor switch 712 is formed by a NPN bipolar junction transistor and a resistor. The bases of the bipolar junction transistors are coupled to the common reference voltage VREF, the emitters of the bipolar junction transistors are coupled to the corresponding current balancing terminals DA1~DAn in the current balancing circuit 620 through the resistor, and the collectors of the bipolar junction transistors are connected with each other. When the level at the current balancing terminal having the lowest level among the current balancing terminals DA1~DAn is lower than the common reference voltage VREF by a predetermined voltage difference, the corresponding bipolar junction transistor becomes conductive and the level at current balancing terminal having the lowest voltage level dominates the level in the detection signal VD.

Figure 8A:
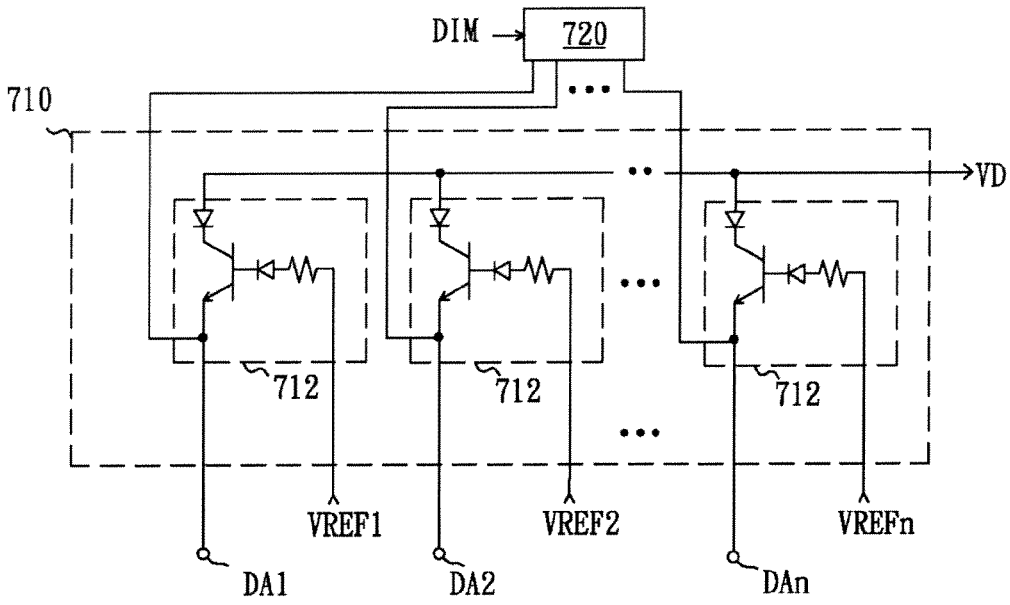
FIG. 8A is a schematic diagram of the multi-load feedback circuit according to an eighth embodiment of the present invention.

In addition, the common reference voltage VREF can also be replaced by the plurality of the reference voltages VREF1~VREFn. Refer to FIG. 8A, wherein a schematic diagram of the multi-load feedback circuit according to an eighth embodiment of the present invention is shown. In the present embodiment, the multi-load feedback circuit 710 comprises a plurality of semiconductor switches 712 and each semiconductor switch 712 comprises a NPN bipolar junction transistor, a resistor and two diodes. The first diode is respectively coupled between a corresponding bipolar junction transistor and a corresponding reference voltage, and the second diode is respectively coupled to a collector of the corresponding bipolar junction transistor. The emitters of the bipolar junction transistors are correspondingly coupled to the current balancing terminals DA1~DAn in the current balancing circuit 720. When the voltages of the current balancing terminals DA1~DAn are abnormal raised, e.g.: the current balancing circuit 720 is stopped the current by the dimming signal DIM or the multi-load feedback circuit is in the abnormal state, a reverse bias voltage may be generated between the emitter and the base of each bipolar junction transistor or between the emitter and the collector thereof. Therefore, in the present embodiment, the diode and resistor are coupled in serial between a base of the corresponding bipolar junction transistor and the corresponding reference voltage of the reference voltages VREF1~VREFn to avoid the plurality of semiconductor switches 712 being damaged because of the weaker withstand voltage.

As the above description, the invention completely complies with the patentability requirements: novelty, non-obviousness, and utility. It will be apparent to those skilled in the art that various modifications and variations can be made to the structure of the invention without departing from the scope or spirit of the invention. In view of the foregoing descriptions, it is intended that the invention covers modifications and variations of this invention if they fall within the scope of the following claims and their equivalents.

What is claimed is:

1. A multi-load feedback circuit, adapted to control a load driving circuit to adjust an electrical power to drive a plurality of loads connected in parallel, comprising:

a plurality of semiconductor switches, each semiconductor switch having a first terminal, a second terminal and a third terminal, wherein the first terminals are respectively coupled to a set of first reference voltages, the second terminals are respectively coupled to corresponding loads, and the third terminals are coupled with each other to generate a detection signal according to each conducting state of the plurality of semiconductor switches in the conducting states, for having the load driving circuit to accordingly adjust the electric power; and a determining circuit used to generate a feedback signal based on the detection signal, wherein the load driving circuit adjusts the electrical power to drive the plurality of loads based on the feedback signal, the determining circuit includes a comparator, in which the inverse terminal of the comparator receives the detection signal and the non-inverse terminal thereof receives a second reference voltage to generate the feedback signal at an output of the comparator.

2. The multi-load feedback circuit according to claim 1, wherein each semiconductor switch includes a first Metal-Oxide-Semiconductor Field Effect Transistor (MOSFET) and a second MOSFET, in which drains of the first MOSFET and the second MOSFET are coupled with each other, gates of the first MOSFET and the second MOSFET are correspondingly coupled to the set of the first reference voltages, a source of the first MOSFET is coupled to a corresponding load, and a body diodes in the first MOSFET and the second MOSFET are arranged in an opposite direction.

3. The multi-load feedback circuit according to claim 1, wherein each semiconductor switch includes a first Metal-Oxide-Semiconductor Field Effect Transistor (MOSFET) and a second MOSFET, in which drains of the first MOSFET and the second MOSFET are coupled with each other, a gate and a source of the first MOSFET are coupled with each other, a gate of the second MOSFET is correspondingly coupled to the set of first reference voltages, the source of the first MOSFET is coupled to a corresponding load, and the body diodes in the first MOSFET and the second MOSFET are arranged in an opposite direction.

4. The multi-load feedback circuit according to claim 1, wherein each semiconductor switch includes a MOSFET, in which MOSFET has a gate correspondingly coupled to the set of first reference voltages, each MOSFET has a source coupled to a corresponding load, and each MOSFET has a base connected to ground.

5. The multi-load feedback circuit according to claim 1, wherein each semiconductor switch includes a bipolar junction transistor having a base, an emitter and a collector, in which one of the emitter and the base for each bipolar junction transistor is correspondingly coupled to the set of first reference voltages, and the other of the emitter and the base for each of the bipolar junction transistor is coupled to a corresponding load.

6. The multi-load feedback circuit according to claim 5, further comprising a plurality of diodes, wherein each diode is respectively coupled between a corresponding bipolar junction transistor and a corresponding load.

7. The multi-load feedback circuit according to claim 5, further comprising a plural set of diodes, wherein each set of diodes includes a first diode and a second diode, the first diode is respectively coupled between a corresponding bipolar junction transistor and the set of first reference voltages, and the second diode is respectively coupled to the collector of the corresponding bipolar junction transistor.

8. The multi-load feedback circuit according to claim 1, wherein the determining circuit further includes a transistor switch, in which the transistor switch has a first terminal, a second terminal and a control terminal, and the first terminal is coupled to a driving voltage, the control terminal is coupled to the set of first reference voltages, the second terminal is coupled to the non-inverse terminal of the comparator, and the inverse terminal of the comparator is applied to receive the detection signal.

9. The multi-load feedback circuit according to claim 1, wherein a level of the second reference voltage is higher than any of the set of first reference voltages.

10. The multi-load feedback circuit according to claim 9, wherein a level of each first reference voltage of the set of first reference voltages are equal.

11. A load driving circuit for driving plural LED strings connected in parallel, comprising:

an electrical power supply, coupled to the plural LED strings for driving the plural LED strings;

a current balancing circuit, including a plurality of current balancing terminals correspondingly coupled to the plural LED strings for balancing the current flowing through the plural LED strings; and a multi-load feedback circuit, including a plurality of semiconductor switches respectively coupled to corresponding current balancing terminals, in which each of the semiconductor switches is conducting or cutoff based on a voltage level of the corresponding current balancing terminal and a common reference voltage;

wherein, the multi-load feedback circuit generates a detection signal based on each of the voltage levels of the current balancing terminals corresponding to any semiconductor switches conducting, for having the electrical power supply to adjust the power to drive the plural LED strings according to the detection signal, and wherein each semiconductor switch includes a first Metal-Oxide-Semiconductor Field Effect Transistor (MOSFET) and a second MOSFET, in which drains of the first MOSFET and the second MOSFET are coupled with each other, gates of the first MOSFET and the second MOSFET are coupled to the common reference voltage, a source of the first MOSFET is correspondingly coupled to the corresponding current balancing terminal, and body diodes in the first MOSFET and the second MOSFET are arranged in an opposite direction.

12. A load driving circuit for driving plural LED strings connected in parallel, comprising: an electrical power supply, coupled to the plural LED strings for driving the plural LED strings; a current balancing circuit, including a plurality of current balancing terminals correspondingly coupled to the plural LED strings for balancing current flowing through the plural LED strings; and a multi-load feedback circuit, including a plurality of semiconductor switches respectively coupled to corresponding current balancing terminals, in which each of the semiconductor switches is conducting or cutoff based on a voltage level of the corresponding current balancing terminal and a plurality of first reference voltages; wherein, the multi-load feedback circuit generates a detection signal based on the voltage levels of the current balancing terminals corresponding to any semiconductor switches conducting, for having the electrical power supply to adjust the power to drive the plural LED strings according to the detection signal, and wherein each semiconductor switch includes a bipolar junction transistor having an emitter, a base and a collector, in which one of the emitter and the base for each of the bipolar junction transistor is correspondingly coupled to one of the plurality of first reference voltages, and the other of the emitter and the base for each of the bipolar junction transistor is coupled to the corresponding current balancing terminal.

13. The load driving circuit according to claim 12, further comprising a plurality of diodes, wherein each diode is respectively coupled between a corresponding bipolar junction transistor and a corresponding load.

14. The load driving circuit according to claim 12, further comprising a plural set of diodes, wherein each set of diodes includes a first diode and a second diode, the first diode is respectively coupled between a corresponding bipolar junction transistor and a corresponding one of the plurality of first reference voltages, and the second diode is respectively coupled to the collector of the corresponding bipolar junction transistor.

15. The load driving circuit according to claim 12, wherein the load driving circuit further comprises a determining circuit used to generate a feedback signal responsive to the detection signal and a second reference voltage, wherein the load driving circuit adjusts the electrical power to drive the plurality of loads based on the feedback signal, and the level of the second reference voltage is higher than any of the plurality of first reference voltages.

* * * * *